United States Patent [19]

Yamaguchi et al.

[11] Patent Number: 4,459,670

[45] Date of Patent: Jul. 10, 1984

[54] FUEL INJECTION CONTROL DEVICE FOR USE WITH AN INTERNAL COMBUSTION ENGINE

[75] Inventors: Hiroshi Yamaguchi; Sadao Takase, both of Yokohama, Japan

[73] Assignee: Nissan Motor Company, Limited, Kanagawa, Japan

[21] Appl. No.: 272,721

[22] Filed: Jun. 11, 1981

Related U.S. Application Data

[63] Continuation-in-part of Ser. No. 97,670, Nov. 27, 1979, abandoned.

[30] Foreign Application Priority Data

Jun. 12, 1978 [JP] Japan ..... 53-149932

[51] Int. Cl.[3] ..... F02D 5/02; F02M 51/00

[52] U.S. Cl. ..... 364/431.10; 123/480; 123/486; 123/491

[58] Field of Search ..... 123/491, 480, 486; 364/431.10

[56] References Cited

U.S. PATENT DOCUMENTS

| | | | |
|---|---|---|---|
| 2,867,200 | 1/1959 | Gryder et al. | 123/491 X |
| 3,646,917 | 3/1972 | Nagy | 123/491 |
| 3,680,532 | 8/1972 | Omori | 123/491 X |
| 3,734,067 | 5/1973 | Glockler et al. | 123/491 X |
| 3,847,130 | 11/1974 | Miyoshi et al. | 123/491 |
| 3,923,031 | 12/1975 | Keranen | 123/491 |
| 4,096,795 | 1/1978 | Long et al. | 123/491 |
| 4,100,891 | 7/1978 | Williams | 123/491 X |
| 4,114,570 | 9/1978 | Marchak et al. | 123/491 |
| 4,128,082 | 12/1978 | Aoki | 123/491 |
| 4,134,368 | 1/1979 | Hadley | 123/491 X |
| 4,148,282 | 4/1979 | Grassle et al. | 123/491 |
| 4,171,692 | 10/1979 | Drews et al. | 123/491 |
| 4,176,629 | 12/1979 | Kawai et al. | 123/486 X |
| 4,184,460 | 1/1980 | Harada et al. | 123/491 X |
| 4,310,888 | 1/1982 | Furuhashi et al. | 123/491 X |

FOREIGN PATENT DOCUMENTS

| | | | |
|---|---|---|---|
| 2054435 | 8/1972 | Fed. Rep. of Germany . | |
| 2006420 | 9/1972 | Fed. Rep. of Germany . | |
| 2135560 | 2/1973 | Fed. Rep. of Germany . | |
| 2237481 | 7/1973 | Fed. Rep. of Germany . | |
| 2017918 | 5/1970 | France . | |
| 2151715 | 4/1973 | France . | |
| 55-151128 | 11/1980 | Japan | 123/491 |

*Primary Examiner*—Felix D. Gruber

*Attorney, Agent, or Firm*—Schwartz, Jeffery, Schwaab, Mack, Blumenthal & Koch

[57] ABSTRACT

A fuel injection control device includes a microcomputer which determines a fuel injection amount based on the engine operation parameters. The microcomputer also actuates the fuel injection valve to open earlier in relation to the normal timing of fuel injection in response to turning on the starter switch. The fuel injection amount corresponds to the duration of opening of the fuel injection valve, and the opening duration of the fuel injection valve is defined by a driving signal and a stopping signal. The driving signal is generated at given angles of crank revolution. The driving signal is generated in response to a preset number of crank angle pulses, which is varied between the first fuel injecting operation and subsequent fuel injecting operations. The fuel injection timing of the first injecting operation is shorter than that of the remainder for improving start-up characteristics of the engine responsive to turning on the starter switch.

24 Claims, 6 Drawing Figures

FUEL INJECTION CONTROL DEVICE FOR USE WITH AN INTERNAL COMBUSTION ENGINE

CROSS REFERENCE TO THE RELATED APPLICATION

The present application is a continuation-in-part application of our co-pending application Ser. No. 097,670, filed in Nov. 27, 1979, now abandoned. Reference is also made to application Ser. No. 356,766, filed Mar. 10, 1982, which is a continuation of copending application Ser. No. 097,670.

BACKGROUND OF THE INVENTION

The present invention relates generally to a fuel injection control device for use with an internal combustion engine for determining the fuel injection amount supplied to the engine based on various engine operation parameters such as engine load, engine speed and/or engine temperature. More particularly, the invention relates to a fuel injection control device with an improved start-up characteristic.

An electronically-controlled fuel injection control device determines a fuel injection amount corresponding to engine operating conditions defined by various engine operation parameters such as, for example, engine load, engine speed, and/or engine temperature. Further, the fuel injection control device corrects the determined fuel injection amount based on the correction parameters for the engine.

The fuel injection devices presently in use inject a predetermined fuel amount once per each revolution of the engine. Fuel injection is effected to all the engine cylinders at the same timing when a reference position pulse is supplied which is output every time the engine crank shaft revolves over a predetermined angle.

For this reason, in the worst case, it may take 360° with respect to the crank angle from the beginning of cranking at start-up of the engine until the fuel injection device calculates the fuel injection amount to thereby actually inject the fuel.

Reference is made, for instance, to a 4-cycle, 6-cylinder reciprocating engine having a sensor for detecting a crank shaft angle position. The sensor outputs a reference position pulse for each given crank angle of 120° (corresponding to an interval of combustion of engine). As shown in FIG. 1, at time $T_1$, cranking starts and after time $T_1$, a reference position pulse No. 1 is generated. Thereafter, whenever the crank shaft revolves over 120°, reference position pulses No. 2, No. 3 . . . are successively generated. In the event that the fuel injection device injects fuel once per each revolution, whenever three reference position pulses are input, i.e. every crank shaft revolving angle of 360°, fuel injection is effected.

In the above example, if cranking begins at $T_1$ fuel injection cannot be effected until the reference position pulse No. 3 is produced. The engine thus starts after reference pulse No. 3 is produced, which results in prolonging the cranking time.

The prolonged or delayed time of fuel injection is in fact merely from a tenth of a second to a few seconds. However, drivers feel that the cranking time is relatively long giving an impression of a bad start-up characteristic.

SUMMARY OF THE INVENTION

With the above in mind, an object of the present invention is to provide a fuel injection control device for use with an internal combustion engine which has an improved start-up characteristic.

Another object of the present invention is to provide a fuel injection control device wherein the control device is constituted by a microcomputer which serves to set a fuel amount to be injected in accordance with table look-up values or which performs other operations before cranking starts and subsequently effects fuel injection as soon as a first reference position pulse is received.

According to the present invention, the above-mentioned and other objects of the invention can be accomplished by an improved fuel injection control device which includes a microcomputer capable of determining a fuel injection amount. The fuel injection control device is responsive to the first crank angle signal fed from the crank angle sensor. A fuel injection pulse is generated by the control device responsive to the first crank angle signal. The control device returns to normal control operation after generating the first fuel injection pulse to generate the normal fuel injection pulse per each given crank revolution angle.

BRIEF DESCRIPTION OF THE DRAWINGS

The features and advantages of a fuel injection control device according to the present invention will become more apparent from the following description taken in conjunction with the accompanying drawings, in which.

DESCRIPTION OF THE PREFERRED EMBODIMENT

Figure 1:
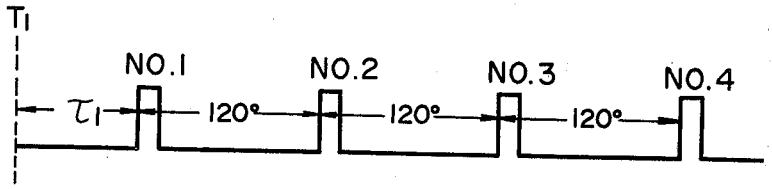
FIG. 1 is, as stated above, a time chart of reference position pulses.
Figure 2:
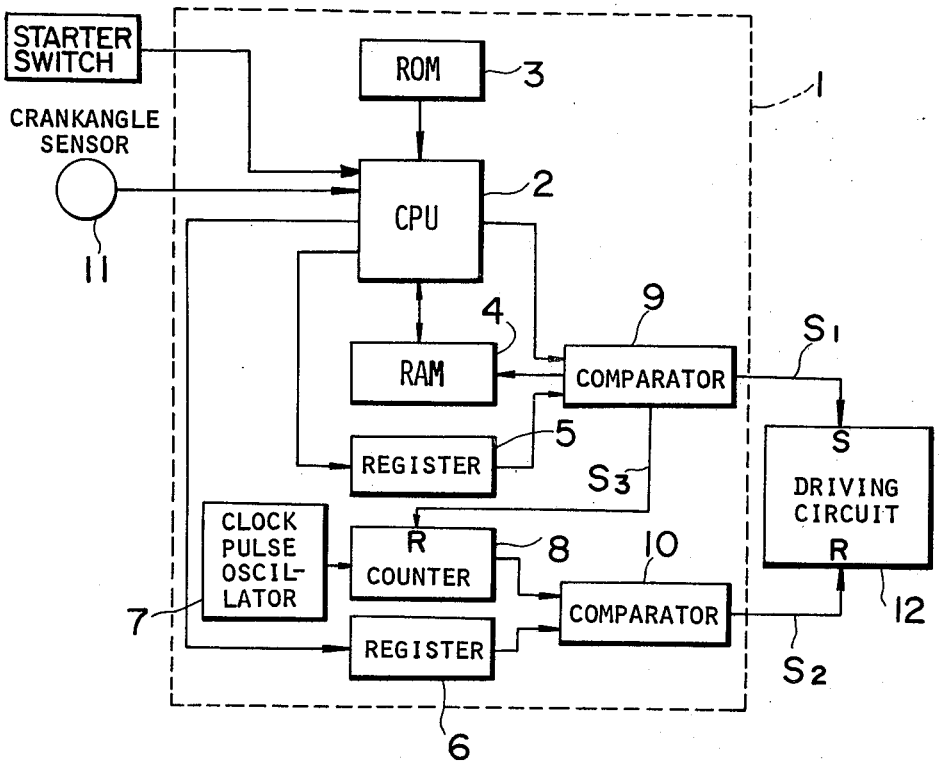
FIG. 2 is a block diagram showing an embodiment of a fuel injection control device according to the present invention.

FIG. 2 is a block diagram illustrating an embodiment of a fuel injection control device according to the present invention wherein the control device includes in a microcomputer designated generally by reference numeral 1. The microcomputer 1 comprises a central processing unit CPU 2, a ROM 3 for storing a program and a look-up table containing values corresponding to injection pulse widths of a fuel injection duration and, in turn, corresponding to the fuel injection amount, a RAM 4 for instantaneous storing control parameters for control operation for the fuel amount injection, write-enable register 5 and 6, a clock oscillator 7, a counter 8, and comparators 9 and 10.

Reference numeral 11 denotes a sensor for detecting a crank angle relative to a standard crank angle. The sensor 11 outputs a crank angle signal at every predetermined crank shaft angle position, e.g. 120°. Reference numeral 12 denotes a driving circuit for driving a fuel injection valve (not shown).

It should be appreciated, though not illustrated in the drawings that, the starter switch is connected with the CPU to feed thereto a signal while the starter switch is turned on.

CPU 2 counts up the crank angle signals successively fed from the sensor 11 and stores the counted value in RAM 4. The CPU 2 is operative to load register 5 which is utilized to store a value which acts as a set or reference value for determining fuel injection timing. The set value stored in the register 5 is compared with the content of the RAM 4 indicative of the current counted value of the crank angle signal. The comparison is effected by means of CPU 2 reading RAM 4 and supplying the current count value to a comparator 9 which also receives a signal corresponding to the value of register 5. Comparator 9 outputs a driving signal $S_1$ when the content of RAM 4 becomes equal to that of the set value of register 5. Responsive to the driving signal $S_1$, the driving circuit 12 becomes operative to open the fuel injection valve for supplying the fuel to the engine. At the same time, the RAM 4 is also responsive to the driving signal $S_1$ which resets the counted value of the crank angle signals. In the event that the set value of register 5 is set at "1", the driving signal $S_1$ is output once for every one crank signal supplied. Also, RAM 4 can be reset to "0" upon the receipt of 3 crank angle signals to indicate completion of one full revolution. In this case, if register 5 is set at "0" the driving signal $S_1$ is supplied once per revolution.

Accordingly, if at the start of cranking, the content of register 5 is set at "1" and after the first fuel injection has been effected is set at "1", a driving signal $S_1$ is output when the first crank angle signal is supplied at the start of cranking, while thereafter the driving signal $S_1$ is output whenever three crank angle signals are supplied, that is, at each engine revolution.

It should be appreciated that the driving signal $S_1$ is a pulse signal generated per every predetermined crank revolution angle. Responsive to the driving signal $S_1$, the driving device for opening the fuel injection valve becomes operative and thereby the fuel injection valve is opened at the corrected crank revolution angle.

On the other hand, the CPU 2 determines a duration of the opening period of the fuel injection valve based on various engine operating parameters, such as for example, engine load, engine speed, engine temperature and so on. In the preferred embodiment, the duration of opening of the fuel injection valve is preliminarily determined corresponding to various engine operating conditions and stored in the ROM 3 in a form of the look-up table to be looked up based on the sensed input parameter. The CPU 2 reads out one of the values in the table. A signal indicative of the determined duration of the opening period of the fuel injection valve is fed to the register by the CPU 2. Thus, the content of register 6 indicates the width of the injection pulse to be produced by driving circuit 12.

The oscillator 7 generates a clock pulse in synchronism with engine operation, for example, in synchronism with the engine revolution. The clock signal generated by the oscillator 7 is fed to the counter 8. The counter 8 counts up the clock pulses. The content of the counter 8 is fed to the comparator 10 in the form of a signal which is compared with the content of the register. The signal from counter 8 is fed to the comparator 10 and is compared with the content of the register 6 by the comparator 10. When the content of the counter 8 becomes equal to the content of the register 6, the comparator 10 generates a stopping signal $S_2$ to be fed to the driving device 12 of the fuel injection valve. Responsive to the stopping signal $S_2$, the driving device becomes operative to close the fuel injection valve. Therefore, the driving signal $S_1$ and the stopping signal $S_2$ define the duration of opening of the fuel injection valve. Here, since the timing of generating the stopping signal $S_2$ is determined corresponding to the preset value read out from the table stored in the ROM 3 based on the various engine operation parameters, the fuel injection amount depending on the opening duration of the fuel injection valve exactly corresponds to the preset value stored in ROM 3.

A reset signal $S_3$ is generated at the same time as generating the driving signal $S_1$ and is fed to the counter 8. The counter 8 is reset in response to the reset signal $S_3$. Therefore, per each fuel injecting operation, the value of the counter 8 is zeroed, and therefore the opening duration of the fuel injection valve is defined by the stopping signal $S_2$ and accurately corresponds to the preset value read out from the table.

In the normal fuel injection control operation, the control device according to the present invention carries out the above-mentioned control operation. However, in case of determining the fuel injection amount for the first fuel injection, the control device operates using some estimated values of operating parameters since the actual engine operation parameters to be used for determining the fuel injection amount are not accurately available at cranking.

Therefore, at the start of cranking, since it is impossible to measure intake air flow and engine revolution (it is impossible to measure these parameters until cranking is commenced and the engine starts), corresponding estimated values are substituted for these parameters and an injection pulse width is determined by detecting only the temperature signal fed from a temperature sensor (not shown). Since intake air flow and engine revolution are substantially constant at the time of cranking, these estimate values may reliably be used in fuel injection control.

Figure 3A:
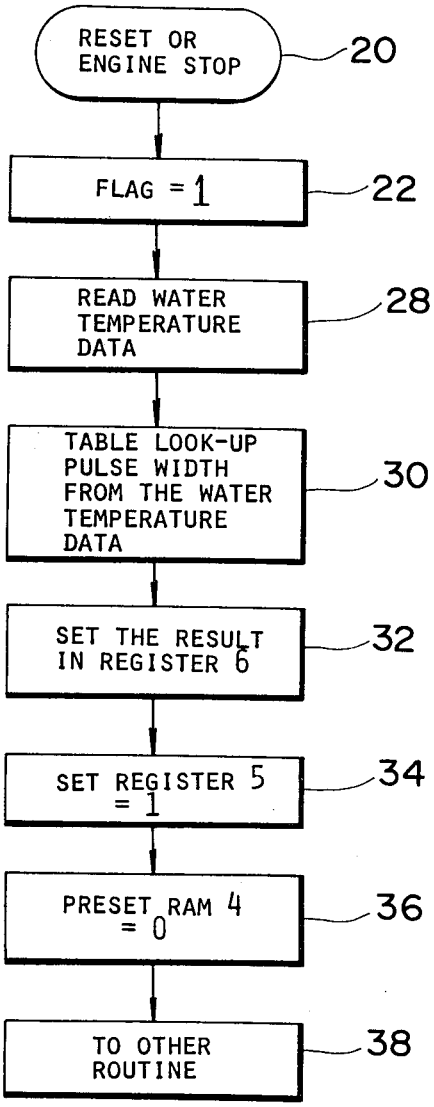
FIGS. 3A and 3B are flowcharts showing a control program of the microcomputer shown in FIG. 2.
Figure 3B:
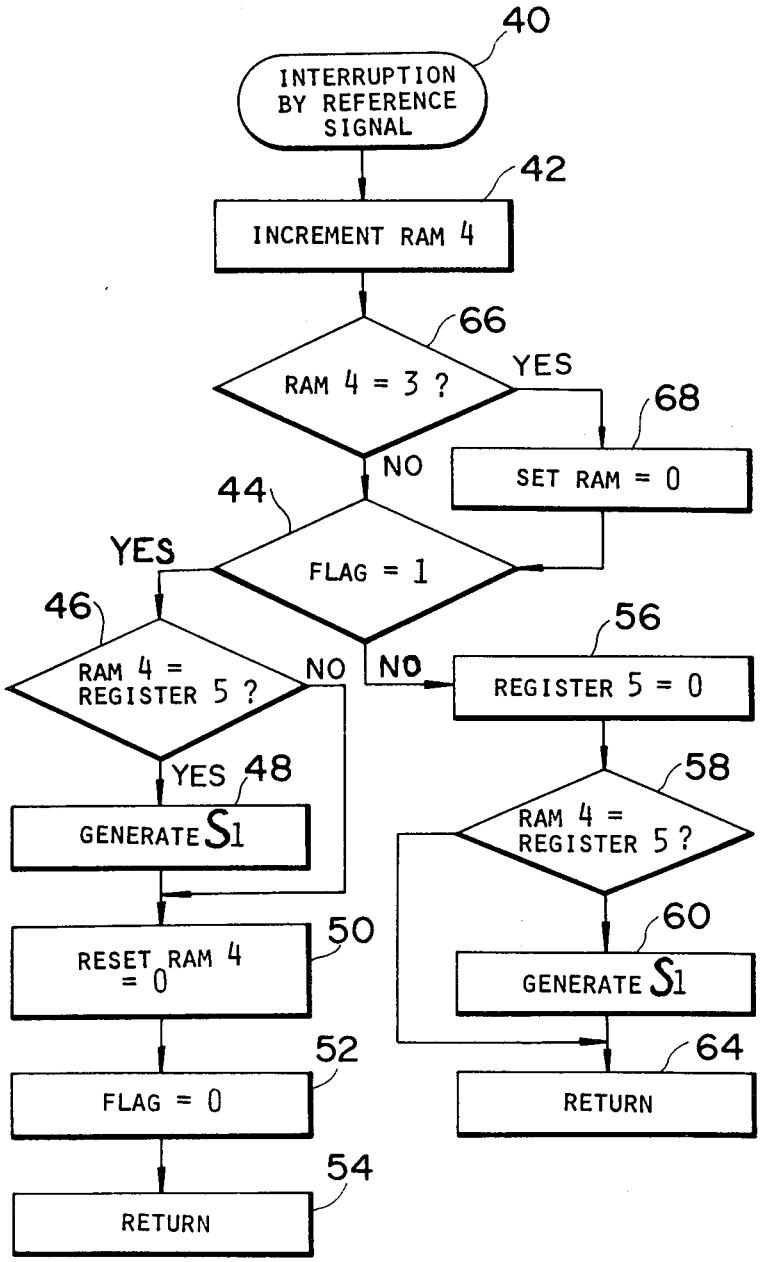

FIGS. 3A and 3B are flowcharts showing the sequence of the above control according to the present invention, wherein FIG. 3A shows a flow digram for fuel injection control and FIG. 3B shows a flow diagram for an interruption of reference signal in cranking.

As shown in FIG. 3A, at the start of execution of the control program preset by step 20, the control device 1 is initialized. Specifically, if the ignition switch is turned on and, therefore, the starter switch outputs signal indicative of the on position thereof, and the engine is still maintained in inoperative condition, the engine starting condition is determined by the CPU and a FLAG is set to "1" showing that the first injection has not yet been produced. The FLAG is set in process step 22. At step 28, the CPU 2 responds to signals from the water temperature sensor (not shown), and uses the water temperature data at step 30 to address the look-up table in ROM 3. The content read out from ROM 3 is indicative of the initial opening duration of the fuel injection amount. The value read out from the ROM 3 is set in the register 6 as indicated at process step 32. Next, the content of register 5 is set at "1" at process step 34, which is denoted by the representation "Register 5 Equals 1" in the flow diagram of FIG. 3A. In step 36, the RAM 4 is preset to zero, and the CPU 2 proceeds to execute other routines in step 38.

Whenever the CPU receives a crank angle signal from the crank angle sensor 11 (serving as reference positive pulse or signal corresponding thereto), the current program sequence being performed by the CPU 2 is interrupted, and the program shown in FIG. 3B is executed as shown in Step 40. In step 42, the contents of RAM 4 are incremented, and the program proceeds to step 66 where it is determined whether the content of the RAM 4 is equal to "3" for detecting one cycle of engine revolution. If "Yes", process goes to step 68 for resetting the content of the RAM 4 to zero. Following to step 68 or if the decision in the step 66 is "No", the program proceeds to step 44 where FLAG is tested. If FLAG equals 1, the CPU 2 has not yet initiated the first injection pulse and compares RAM 4 with the contents of register 5 in step 46. If RAM 4 equals register 5, the CPU goes to step 48 where the signal $S_1$ is generated and fed to the driving circuit 12 for initiating the injection pulse. From step 48 the program proceeds to step 50 where RAM is reset. At step 52, the FLAG is set to "0" since the first injection pulse has been initiated. In step 54, the interrup routine returns to the main program. If in step 46, the contents of RAM 4 were not found to be equal to the contents of register 5, the program branches to step 50.

In step 44, the FLAG may have a value 0, as for example during all injection times except the first injection immediately following cranking. Thus, in the occurrence of the second interrupt caused by the second crank angle signal, the FLAG is found in step 44 to have a value equal to zero. In this case, the program goes to step 56 where register 5 is loaded by the CPU with a value of 0. In step 58, the program compares the contents of RAM 4 with the contents of register 5. The signal $S_1$ is generated at step 60. The interrupt routine the returns to the main program in step 64. If RAM 4 was not equal to register 5 in step 58, the program branches to return step 64.

Figure 4A:
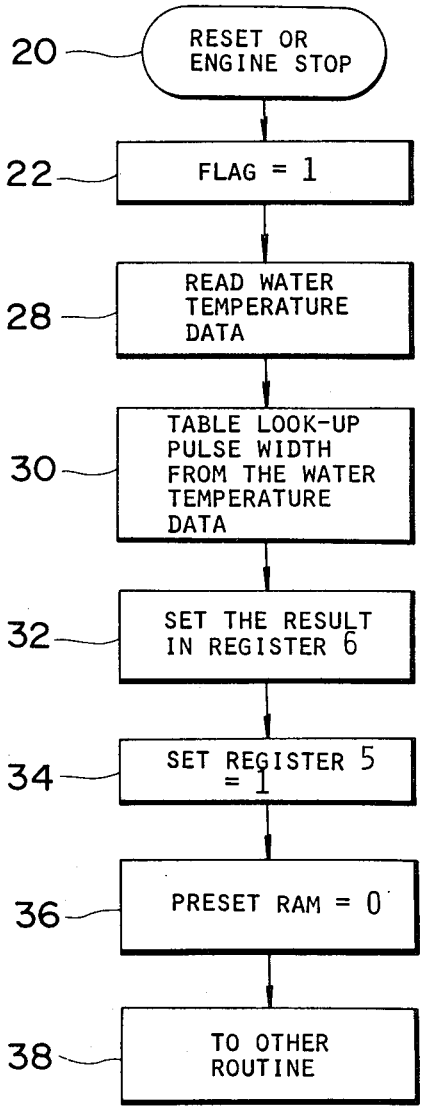
FIGS. 4A and 4B are flowcharts showing a modification of control program of the microcomputer shown in FIG. 2.
Figure 4B:
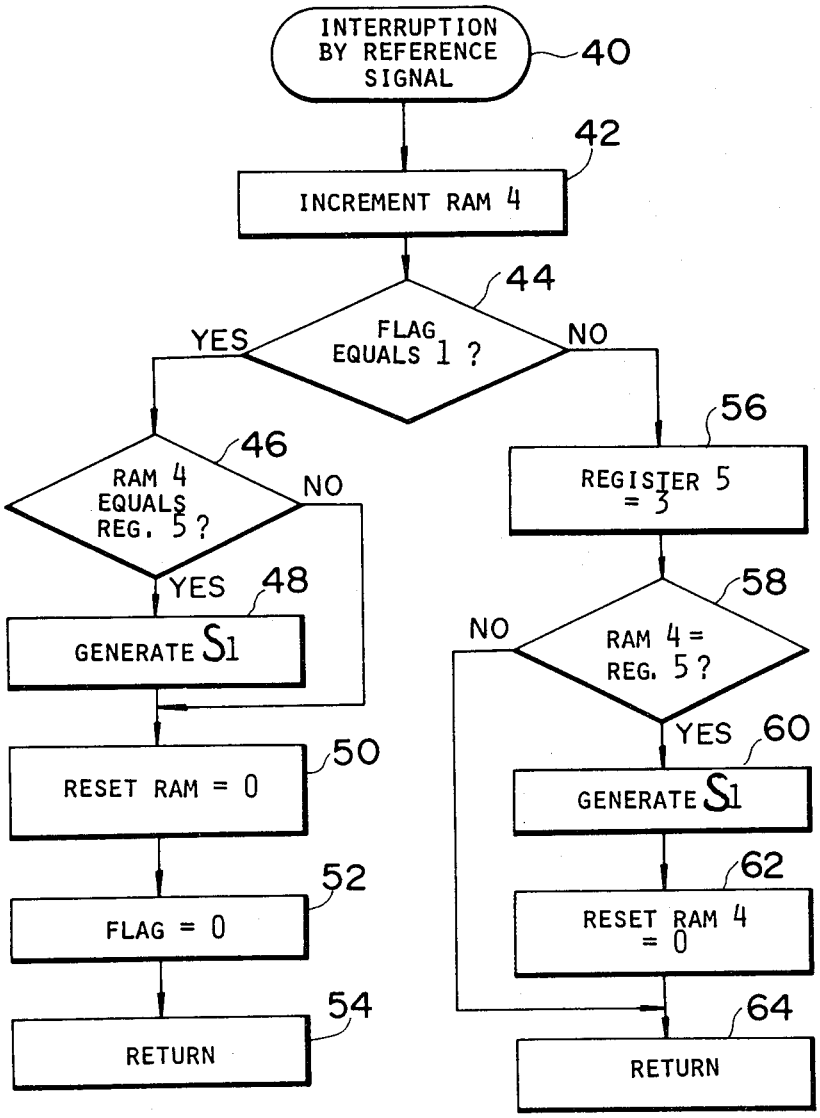

It will be appreciated the logic of the present invention can be embodied otherwise with any other programs operating the CPU, RAM, ROM and registers. For example, FIGS. 4A and 4B show one of the modifications. In FIG. 4A, the set value of the FLAG in step 22 is "1". As in the foregoing embodiment, whenever the CPU receives a crank angle signal from the crank angle sensor 11 (serving as reference position pulse or signal corresponding thereto), the current program sequence being performed by the CPU 2 is interrupted, and the program shown in FIG. 3B is executed as shown in Step 40. In step 42, the contents of RAM 4 are incremented, and the program proceeds to step 44 where FLAG is tested. If FLAG equals 1, the CPU 2 has not yet initiated the first injection pulse and compares RAM 4 with the contents of register 5 in step 46. If RAM 4 equals register 5, the CPU goes to step 48 where the signal $S_1$ is generated and fed to the driving circuit 12 for initiating the injection pulse. From step 48 the program proceeds to step 50 where RAM 4 is reset. At step 52, the FLAG is reset to zero since the first injection pulse has been initiated. In step 54, the interrupt routine returns to the main program. If in step 46, the contents of RAM 4 were not found to be equal to the contents of register 5, the program branches to step 50.

In step 44, the FLAG may have a value 0, as for example during all injection times except the first injection immediately following cranking. Thus, in the occurrence of the second interrupt caused by the second crank angle signal, the FLAG is found in step 44 to have a value equal to zero. In this case, the program goes to step 56 where register 5 is loaded by the CPU with a value of 3. In step 58, the program compares the contents of RAM 4 with the contents of register 5. The signal $S_1$ is generated and thence to step 62 where the RAM 4 is reset to zero. The interrupt routine the returns to the main program in step 64. If RAM 4 was not equal to register 5 in step 58, the program branches to return step 64.

With the program thus obtained, after cranking action starts and at the time of the first crank angle signal reference position pulse is input (after cranking action starts and within the time until the crank shaft revolves over 120° at a maximum), fuel injection is effected and thereafter, whenever three reference position pulses are input (each revolution), fuel injection is again effected.

In the four-cycle engine, combustion within a given cylinder takes place once every two revolutions of the cylinders. Accordingly, with respect to the engine wherein each cylinder is simultaneously injected once every revolution, the amount of fuel for each injection is selected to be one-half that of the total fuel amount required, and therefore, injecting twice leads to the fuel amount required. However, in regard to the first fuel injection at the time of cranking, since it is necessary to supply fuel in an amount close to the total fuel amount required by only injecting once, a preferable fuel injection control may be effected when the amount of fuel at the time of the first injection is set at one and a half times that of the usual injection.

According to the fuel injection control device of the present invention, since at the time of cranking, the timing of the commencement of fuel injection becomes earlier than that of the conventional time, it is possible to improve the start-up characteristics of an engine wherein the fuel injection apparatus is assembled. With a microcomputer as a control device, it is sufficient to modify or change the program in order to effect the desired fuel injection control, so that it is possible to improve the performance of fuel injection without increasing costs.

It is to be understood that modification and variations of the embodiments of the present invention disclosed herein may be resorted to without departing from the spirit of the invention and the scope of the appended claims.

What is claimed is:

1. A fuel injection control system for an internal combustion engine having a fuel injection valve, comprising:

a crank angle sensor for producing a crank angle signal for each predetermined angle of crank revolution of said engine;

a driving circuit associated with said fuel injection valve for controlling the operation of said fuel injection valve for performing fuel injections in controlled amounts and at controlled timing;

a microcomputer adapted to distinguish a first crank angle signal produced immediately after cranking action starts and subsequent crank angle signals, said microcomputer being operative for counting said crank angle signals and comparing said counted crank angle signals with a preset value and producing a driving signal for operating said driving circuit when said counted value reaches said preset value, and said microcomputer being operative to set said preset value at one prior to receipt of said first crank angle signal so that a first fuel injection is performed in response to said first crank angle signal and operative to set said preset value to a given normal value before receipt of subsequent crank angle signals so that subsequent fuel injections are performed when a given number of crank angle signals are inputed.

2. A fuel injection control system as defined in claim 1, wherein said microcomputer executes a program organized so as to effect said first fuel injection when said first crank angle signal is received, and to effect subsequent fuel injections whenever said given number of crank angle signals are received.

3. A fuel injection control system as defined in claim 1 or 2, wherein said microcomputer includes a memory for storing fuel injection values in a form of a table to be read out in terms of an engine temperature and being associated with an engine temperature sensor producing an engine temperature signal indicative of the engine temperature, said microcomputer being responsive to said engine temperature signal to read out a value corresponding to the fuel injection amount to be injected based on the engine temperature from the table in said memory.

4. A fuel injection control system as defined in claim 3, wherein said microcomputer is programmed to calculate a fuel injection amount for the first fuel injection to be approximately one and a half times the usual fuel amount to be injected during said subsequent fuel injections which correspond to the same engine temperature.

5. A fuel injection control device for an internal combustion engine for controlling fuel injection timing and fuel injection amount based on various engine operation parameters, which control device includes a microcomputer controlled by a central processing unit, and memory unit, a crank angle sensor for detecting crank angle and generating a crank angle signal per each given crank revolution angle and a fuel injection valve with an actuator for operating the fuel injection valve responsive to a fuel injection signal generated and fed from the microcomputer, wherein the improvement comprises:

said microcomputer further including a counter means for counting up the crank angle signals and generating a fuel injection signal when the count of crank angle signals becomes equal to a preset value, said microcomputer being operative to discriminate between a first crank angle signal and subsequent crank angle signals, and to set said preset value to a first value prior to said first crank angle signal and to a given value prior to said subsequent crank angle signals, wherein said preset value for the first fuel injection is less then that for subsequent fuel injections for reducing lag of response from start-up operation.

6. A fuel injection control device as defined in claim 5, wherein said memory unit contains a table storing various predetermined values of fuel injection amount and said central processing unit reads out one of said predetermined values based on an engine temperature measured by an engine temperature sensor.

7. A fuel injection control device as defined in claim 6, wherein said microcomputer further comprises a means for generating clock signals, means for generating a count of the clock signals, means for comparing said count of clock signals with the predetermined value corresponding to the determined fuel injection amount, and means for generating a command signal for making said actuator inoperative, whereby said command signal defines the duration of opening of said fuel injection valve in cooperation with said fuel injection signal.

8. A fuel injection control system as defined in claim 5, wherein said preset value for determining the fuel injection timing is set in said memory unit, said microcomputer being operative to discriminate between said first fuel injection and subsequent fuel injections based on an engine starter switch position and engine inoperative conditions, and wherein said microcomputer is operative to set said preset value to 1 in order to effect said first fuel injection in response to the first crank angle signal.

9. A fuel injection control device as defined in claim 5 or 8, wherein said subsequent fuel injections following the first fuel injection are effected per one cycle of crank shaft revolution.

10. A fuel injection control system for a fuel injection type internal combustion engine comprising:

a crank angle sensor for determining crank revolution angle and generating a crank angle signal per each given crank revolution angle;

an engine temperature sensor for determining engine temperature;

a fuel injection valve with an actuator for controlling opening and closing of said valve;

a control means for counting up said crank angle signals and comparing the count of crank angle signals with a preset value to determine fuel injection timing, said control means generating a fuel injection signal when said count of crank angle signals becomes equal to said preset value, said control means being operative to distinguish between a first crank angle signal and subsequent crank angle signals, said control means being operative to set said preset value at 1 prior to said first crank angle signal, and to set said preset value at a given value prior to said subsequent crank angle signals; and control means for storing fuel injection amounts corresponding to engine operation parameters in a form of a table, said control means determining the fuel injection amount from said table, and setting the fuel injection amount for the first fuel injection to an initial preset value independent from said table, but based on engine temperature.

11. A fuel injection control device as defined in claim 10, wherein said control means determine the fuel injection amount based, at least in part, on the engine temperature determined by said engine temperature sensor for said subsequent fuel injections.

12. A fuel injection control device as defined in claim 10 or 11, wherein said fuel injection amount for the first fuel injection is approximately one and a half times the fuel injection amount to be injected in subsequent fuel injections based on similar operation parameters.

13. A fuel injection control device as defined in claim 10 or 11, wherein said control means comprises a microcomputer system.

14. In a fuel injection control device for an internal combustion engine for controlling fuel injection amount and fuel injection timing based on various engine operation parameters, which control device includes a microcomputer controlled by a central processing unit, memory unit, and counters, a crank angle sensor for detecting crank angle and generating a crank angle signal per each given crank revolution angle and a fuel injection valve responsive to a fuel injection pulse generated and fed from the microcomputer, a method for controlling fuel injection comprising the steps of:

detecting a first crank angle signal produced immediately after cranking action starts;

producing a first fuel injection pulse for performing a first fuel injection in response to said first crank angle signal; and counting said crank angle signals produced subsequent to said first crank angle signal and comparing the counted crank angle signal number with a first preset value to determine fuel injection timing for subsequent fuel injections.

15. A method as defined in claim 14, wherein said method further comprises the steps of:

generating clock signal pulses, counting up said clock signal pulses to produce a counted clock signal, comparing the counted clock signal with a value corresponding to a determined fuel injection amount, and, when the counted clock signal becomes equal to said value indicative of the fuel injection amount, generating a command to close said fuel injection valve.

16. A method as defined in claim 14 or 15, wherein said first preset value is set to 1 prior to detecting the first crank angle signal and is set to 3 prior to detecting subsequent crank angle signals, and wherein said crank angle signal is generated per every 120° of crank revolution.

17. In an electronically controlled single-point fuel injection device for an internal combustion engine, said fuel injection device being of the type wherein fuel injection is effected simultaneously to all cylinders, including a fuel injection valve, a microcomputer and means for generating a crank angle signal at given crank revolution angles, said microcomputer receiving and being responsive to said crank angle signals for effecting fuel injection whenever the number of crank angle signals is more than that of a predetermined number;

the improvement comprising:

said microcomputer being operative for discriminating between the first fuel injection effected immediately after cranking action starts and subsequent fuel injections being effected thereafter, said microcomputer comparing the number of received crank angle signals to a preset value, said preset value having a first value for effecting the first fuel injection and a second, greater value, for effecting subsequent fuel injections, said microcomputer generating a driving signal when the number of received crank angle signals equals said preset value; and a driving circuit for controlling opening and closing of a fuel injection value, said driving circuit being responsive to said driving signal generated by said microcomputer to open said fuel injection valve, whereby said microcomputer effects said first fuel injection when the number of crank angle signals is equal to said first value and effects subsequent fuel injections whenever a predetermined number of crank angle signals are received, equal to said second value.

18. A fuel injection control device for an internal combustion engine for controlling fuel injection timing and fuel injection amount based on various engine operation parameters, which control device includes a microcomputer controlled by a central processing unit, and memory unit, a crank angle sensor for detecting crank angle and generating a crank angle signal per each given crank revolution angle and a fuel injection valve with an actuator for operating the fuel injection valve responsive to a fuel injection signal generated and fed from the microcomputer, wherein the improvement comprises:

said microcomputer being operative for counting up the crank angle signals and generating a fuel injection signal when the count of crank angle signals becomes equal to a preset value and being responsive to the first crank angle signal to produce the first fuel injection signal and being operative for discriminating between a first fuel injection and subsequent fuel injections, wherein the first fuel injection is effected in response to the first crank angle signal and the subsequent fuel injections are effected whenever counted crank angle signals become equal to a preset value.

19. A fuel injection control system of the type wherein fuel injection is effected simultaneously for all cylinders of an internal combustion engine, comprising:

a crank angle sensor for determining crank revolution angle and generating a crank angle signal per each given crank revolution angle;

an engine temperature sensor for determining engine temperature;

a fuel injection valve with an actuator for controlling opening and closing of said valve;

a control means for counting up said crank angle signals and comparing the counted crank angle signal with a first preset value to determine fuel injection timing, said control means generating a fuel injection signal when said counted crank angle signal becomes equal to said first preset value and said control means discriminating between a first fuel injection at engine cranking and subsequent fuel injections, and setting a different preset value when the first fuel injection is effected to reduce the first preset value in relation to that for the subsequent fuel injections so that the first fuel injection is effected in response to the first crank angle signal.

20. A fuel injection control system for an internal combustion engine, comprising:

a fuel injection valve for injecting a controlled amount of a fuel at a controlled timing;

a crank angle sensor for producing a crank angle signal for each predetermined angle of crank revolution of said engine;

an engine temperature sensor for detecting temperature of said engine and producing an engine temperature signal having a value representative of said detected engine temperature;

a controller for producing fuel injection signals having a value representative of fuel injection amount to be injected at a given timing, said controller including:

a flag register having set and reset states, said flag register assuming said set state responsive to the first crank angle signal produced immediately after cranking action starts;

a preset value register for storing a preset value defining fuel injection timing in relation to engine revolution, said preset value register being associated with said flag register, said preset value register being preset to a first value when said flag register is in said reset state and being preset to a second value when said flag register is in said set state;

a counter for counting up crank angle signals and producing a counter signal having a value indicative of said counted crank angle signals;

a comparator for comparing said set value of said preset value register and said counter signal value to produce a comparator signal when said counter signal value is equal to said preset value; and a signal generator for producing said fuel injection signal in response to said comparator signal, said signal generator being responsive to said engine temperature signal to determine said fuel injection signal value dependent on said engine temperature signal value.

21. The fuel injection control system as set forth in claim 1, further comprising a memory incorporated in said controller and adapted to store values respectively indicative of fuel injection amounts in a form of a table which is to be read out in terms of the engine temperature signal value, and said signal generator being associated with said memory for reading out the stored values according to the engine temperature signal values inputted.

22. The fuel injection control system as set forth in claim 20 or 21, wherein said counter is associated with said signal generator and is responsive to said fuel injection signal to clear said counter value.

23. The fuel injection control system as set forth in claim 22, wherein said signal generator determines a fuel injection amount for the first fuel injection, said first fuel injection amount being approximately one and a half times that of the usual fuel injection amount to be injected which corresponds to the engine temperature.

24. The fuel injection control system as set forth in claim 20, wherein said engine includes a starter having an ON position and an OFF position, wherein said flag register is maintained in said set state as long as said starter switch is held in said OFF position and is placed in said reset state in response to said first crank angle signal.

* * * * *